United States Patent [19]

Stern et al.

[11] Patent Number: 4,575,727

[45] Date of Patent: Mar. 11, 1986

[54] MONOLITHIC MILLIMETER-WAVE ELECTRONIC SCAN ANTENNA USING SCHOTTKY BARRIER CONTROL AND METHOD FOR MAKING SAME

[75] Inventors: Richard A. Stern, Allenwood; Elio A. Mariani, Hamilton Square, both of N.J.

[73] Assignee: The United States of America as represented by the Secretary of the Army, Washington, D.C.

[21] Appl. No.: 505,667

[22] Filed: Jun. 20, 1983

[51] Int. Cl.[4] ..... H01Q 13/24

[52] U.S. Cl. ..... 343/768; 343/785; 333/164; 357/15

[58] Field of Search ..... 333/164, 157, 156, 161, 333/248, 250, 258, 262, 245; 343/770, 785, 754, 701, 767, 768, 777, 778; 357/15, 22

[56] References Cited

U.S. PATENT DOCUMENTS

| | | | |
|---|---|---|---|
| 3,959,794 | 5/1976 | Chrepta et al. | 343/785 |
| 4,203,117 | 5/1980 | Jacobs et al. | 343/754 X |
| 4,382,261 | 5/1983 | Freibergs et al. | 343/754 X |
| 4,389,660 | 6/1983 | Decker | 357/15 X |
| 4,468,673 | 8/1984 | Stern et al. | 343/770 X |

OTHER PUBLICATIONS

Fleming, P. L. et al., "Gatts SAMP Device for Ku--Band Switching", Conf. 1979, IEEE MTT-S Int'l Microwave Symposium Digest, Orland, Fla., Apr. 30-May 2, 1979.

*Primary Examiner*—Eugene R. LaRoche
*Assistant Examiner*—Benny T. Lee
*Attorney, Agent, or Firm*—Anthony T. Lane; Jeremiah G. Murray; Paul A. Fattibene

[57] ABSTRACT

A millimeter-wave electronic scan, phased array antenna in a slotted dielectric waveguide having a semi-insulating core and at least one semi-conducting epitaxial layer. A controller affixed to the epitaxial layer is used to apply a bias voltage thereby varying the conductivity of the layer and influencing wave propagation in the guide to effect beam scanning.

12 Claims, 6 Drawing Figures

MONOLITHIC MILLIMETER-WAVE ELECTRONIC SCAN ANTENNA USING SCHOTTKY BARRIER CONTROL AND METHOD FOR MAKING SAME

STATEMENT OF GOVERNMENT INTEREST

The invention described herein may be manufactured, used and licensed by or for the Government for Governmental purposes without the payment to us of any royalties thereon or therefor.

CROSS REFERENCE TO RELATED APPLICATIONS

This application is related to the following co-pending applications filed in the names of R. A. Stern and E. A. Mariani, the present inventors:

U.S. Ser. No. 505,668, entitled, "Millimeter-Wave Electronic Phase Shifter Using Schottky Barrier Control", filed on June 20, 1983; and U.S. Ser. No. 505,666, entitled, "Millimeter-Wave Cut-Off Switch", filed on June 20, 1983.

BACKGROUND OF THE INVENTION

This invention relates generally to millimeter-wave antennas and, more particularly, to a monolithic, electronic scan, phased array antenna system.

One of the major problems inherent in the use of millimeter-wave, phased array antennas concerns the inability to produce the low-cost, high-precision scanning and control devices that the existing designs require. Generally speaking, the present construction methods involve the individual fabrication of discrete elements which are later assembled piece-by-piece, into a multi-element array. One such design is set forth in U.S. Pat. No. 3,959,794 which uses bulk semiconductor PIN diodes as control elements in a dielectric waveguide antenna. The use of these discrete elements results in significant perturbation and distortion of the propagating wave thereby adversely affecting antenna performance. A further drawback of this design concerns the complexity and accompanying high cost of fabrication of such devices.

SUMMARY OF THE INVENTION

The object of this invention is to provide a low-cost, monolithic antenna structure for electronically-controlled beam scanning operable at millimeter-wave frequencies.

A further object of the invention is to provide an antenna design of monolithic geometry which is adaptable to batch fabrication techniques such that numerous devices may be simultaneously and identically produced.

The millimeter-wave electronic scan antenna according to the invention comprises a semi-insulating (dielectric) waveguide having a semi-conducting epitaxial layer on at least one side surface of the guide with distributed Schottky barrier control elements deposited on the epitaxial layer. Periodic slots in the upper surface of the guide act as radiating elements while beam scanning is effected by varying the bias voltage across the Schottky barrier element.

This and other objects and advantages of the invention will become apparent from the following detailed description and drawings.

DETAILED DESCRIPTION OF THE PREFERRED EMBODIMENT

Figure 1:
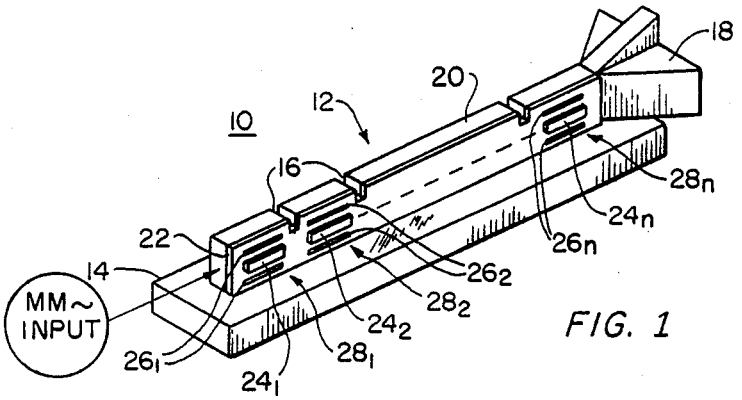
FIG. 1 is a pictorial representation of an antenna according to the invention.

Referring to FIG. 1, a dielectric antenna array 10 in shown having dielectric waveguide 12 mounted on dielectric support 14. Periodically spaced, transverse slots 16 on the top of the waveguide 12 act as perturbations to an RF field propagating down the length of the slotted array causing the waveguide to function as an antenna. A wave of millimeter wavelength is propagated into waveguide 12 at the input end and absorber 18 prevents the reflection back into waveguide 10 of any wave energy which has not been radiated.

Dielectric waveguide 12 is actually made up of two sections: a semi insulating (dielectric) core 20 and a semi-conducting epitaxial layer 22, both preferably of gallium arsenide having a relative dielectric constant, $\epsilon_r$, on the order of 13. Other dielectrics that have semi-conductive or semi-insulating properties can be used, such as silicon. The terms semi-insulating and semi-conducting are used herein in the relative sense such that the semi-conducting material has a greater number of available conducting electrons than the semi-insulating material. The thickness of the epitaxial layer 22 is determined by the design operating frequency and will generally range from about two to ten microns.

The beam scanning function of the antenna is accomplished by a plurality of phase shifter elements 28 deposited on at least one side surface of waveguide 12 and interposed between radiating slots 16. While a more detailed description of the phase shifter elements is found in U.S. patent application Ser. No. 505,668 entitled "Millimeter-Wave Electronic Phase Shifter Using Schottky Barrier Control", by the present inventors, the basic design of these devices will be described in reference to FIG. 2 showing a cross-section of a portion of the antenna 10.

Figure 2:
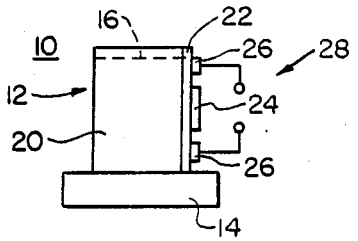
FIG. 2 is an end view of a section of the antenna of FIG. 1.

Again in FIG. 2, waveguide 12 comprises a semi-insulating dielectric core 10 and a semi-conducting epitaxial layer 22. A Schottky barrier electrode 24, which is typically a metallization layer having a thickness on the order of 1000 Å, and ohmic contacts 26 are provided on the outer surface of epitaxial layer 22 as a means for varying the conductivity of the layer 22 thereby altering the propagation characteristic of the device. More specifically, as the voltage applied to ohmic contacts 26 changes from zero bias to a reverse bias voltage on the order of −10 to −20 volts, the depletion depth of the semi-conducting layer is decreased. This in turn changes the device insertion phase at this section of the waveguide and produces a phase shift. An alternate embodiment of the device uses a second phase shifter element affixed to the other side of waveguide 12. This alternate embodiment results in a greater degree of phase shift per unit length in the device.

In terms of actual construction of the device of FIGS. 1 and 2, waveguide 12 is of a low-loss semi-insulating material, preferably gallium arsenide having a relative dielectric constant on the order of 13, and support 14 is a dielectric having a constant ranging from 2 to 4. The Schottky barrier metallization thickness should be on the order of one skin depth or less for the design operating frequency so that the electrode itself will not interfere with the E-field distribution in the waveguide. This criteria may be satisfied for the 35 GHz operating range by using a copper deposit of about 0.1 microns thickness. Finally, the slot separations between adjacent grooves for 35 GHz and 94 GHz operating frequencies should be approximately 0.150 in. and 0.050 in., respectively.

Figure 3:
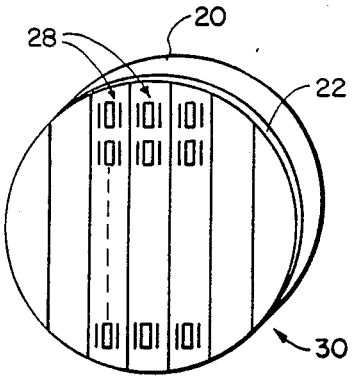
FIG. 3 shows a semiconductor wafer having a matrix of phase shifter control elements deposited thereon.
Figure 4:
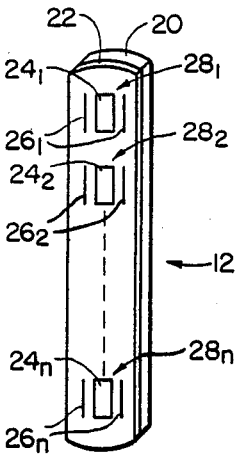
FIG. 4 shows a detail view of one section of the matrix of FIG. 3.
Figure 5:
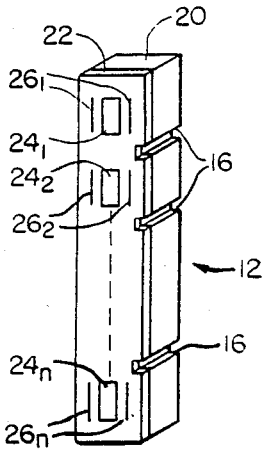
FIG. 5 is a pictorial view of an antenna array according to a preferred embodiment of the invention.

As previously mentioned, the design of the invention offers the added advantage of being compatable with microelectronic fabrication techniques. FIG. 3 illustrates a GaAs semiconductor wafer 30 with a matrix array of phase shifter elements 28 deposited thereon using state-of-the-art microelectronic techniques for fabricating Schottky barrier diodes. The wafer 30 consists of an epitaxial layer 22 of semi-conducting GaAs on a semi-insulating GaAs substrate 20. FIG. 4 represents a slice from the wafer 30 corresponding to waveguide 12 of FIGS. 1 and 2 and comprises a linear array of phase shifter elements 28, each consisting of a Schottky barrier electrode 24 and ohmic contacts 26 as described previously. FIG. 5 depicts the waveguide 12 of a slotted antenna array which results from adding slots 16 to the narrow-edge of the GaAs guide 12. In accordance with well known antenna design techniques, the slots should be spaced one guide wavelength, $\lambda g$, apart and interposed between adjacent phase shifter elements.

Figure 6:
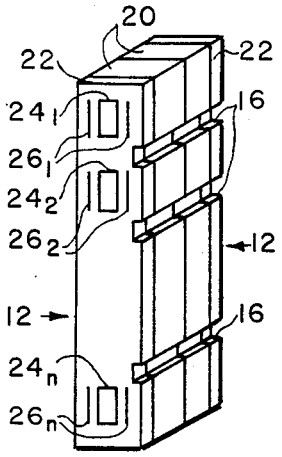
FIG. 6 is a pictorial view of the bonded antenna array according to another embodiment of the invention.

This method of fabrication also lends itself well to the compound structure of the alternate embodiment which uses a first and second phase shifter elements affixed to opposite sides of the waveguide to produce an enhanced phase shift per unit length. In this case and in reference to FIGS. 5 and 6, two waveguide arrays 12 would be bonded back-to-back so that the two epitaxial layers 22 would be at the outer edges and the two semi-insulating substrates 20 would be bonded together. More specifically with reference to FIG. 6, two waveguide arrays 12 are shown bonded together so that the epitaxial layers 22 are on opposing outer surfaces. Each waveguide array 12 has an epitaxial layer 22 on a side surface on which is formed a linear array of Schottky barrier electrodes $24_1$–$24_n$ and ohmic contacts $26_1$–$26_n$. Between each Schottky electrode $24_1$–$24_n$ and ohmic contacts $26_1$–$26_n$ are lateral slots 16 spaced in accordance with well known antenna design techniques.

The net result of the proposed fabrication method could produce, from a single 3-inch semiconductor wafer, approximately fifteen to twenty multi-element antenna arrays for a 35 GHz design and approximately fifty such arrays for a 94 GHz design.

It should be understood, of course, that the foregoing disclosure relates only to the preferred embodiment of the invention and that numerous modifications or alterations may be made therein without departing from the spirit and scope of the invention as set forth in the appended claims.

What is claimed is:

1. A monolithic, millimeter-wave electronic scan antenna comprising:

a longitudinal section of dielectric waveguide having a rectangular cross-section;

said waveguide having a semi-insulating dielectric core and a first semi-conducting epitaxial layer formed on a first side surface of said waveguide;

a plurality of first Schottky barrier electrode means, affixed to said first epitaxial layer, for varying the conductance of said first epitaxial layer;

a plurality of first ohmic contact means, affixed to said first epitaxial layer adjacent and associated with the Schottky barrier electrodes of said plurality of first Schottky barrier electrode means, for applying a bias voltage to vary the conductivity of said first epitaxial layer;

a plurality of periodic radiating slots formed in the upper surface of said waveguide;

means for applying millimeter wavelength travelling waves to one end of said waveguide; and absorber means affixed to the other end of said waveguide;

whereby the varying of the conductivity of said first epitaxial layer causes said waveguide to alter the propagation characteristic of said travelling waves thereby creating a phase shift of said travelling waves which results in beam scanning by said antenna.

2. An antenna as set forth in claim 1 where said waveguide has a design operating frequency wherein said plurality of first Schottky barrier electrode means is a metallization layer having a thickness of less than one skin depth for the design operating frequency.

3. An antenna as set forth in claim 1 further comprising:

a second semi-conducting dielectric epitaxial layer formed on a second side surface of said waveguide opposite said first side surface;

a plurality of second Schottky barrier electrode means, affixed to said second epitaxial layer, for varying the conductance of said second epitaxial layer; and a plurality of second ohmic contact means, affixed to said second epitaxial layer adjacent and associated with the Schottky barrier electrodes of said plurality of second Schottky barrier electrode means, for applying a bias voltage to vary the conductivity of said second epitaxial layer;

whereby the varying of the conductivity of said second epitaxial layer further causes said waveguide to alter the propagation characteristic of said travelling waves thereby creating a further phase shift of said travelling waves which results in further beam scanning by said antenna.

4. An antenna as set forth in claim 3 where said waveguide has a design operating frequency wherein said plurality of second Schottky barrier electrode means comprises a metallization layer having a thickness of less than one skin depth for the design operating frequency.

5. An antenna as set forth in claim 1 further comprising:

dielectric support means affixed to the bottom surface of said waveguide.

6. An antenna as set forth in claim 3 wherein said plurality of second Schottky barrier electrode means and said plurality of second ohmic contact means include a linear array of Schottky barrier electrodes and associated ohmic contacts interposed between said radiating slots along the longitudinal direction of said waveguide.

7. An antenna as set forth in claim 6 wherein said first and said second Schottky barrier electrode means have an equal number of Schottky barrier electrodes.

8. An antenna as set forth in claim 1 wherein said plurality of first Schottky barrier electrode means and said plurality of first ohmic contact means include a linear array of Schottky barrier electrodes and associated ohmic contacts interposed between said radiating slots along the longitudinal direction of said waveguide.

9. An antenna as set forth in claim 1 wherein said semi-insulating dielectric core and said semi-conducting epitaxial layer formed are of gallium arsenide.

10. An antenna as set forth in claim 1 wherein said semi-insulating core and said semi-conducting epitaxial layer are formed of silicon.

11. A method of fabricating a monolithic, millimeter-wave electronic scan antenna comprising the steps of:

forming a semi-conducting epitaxial layer on a surface of a semi-insulating dielectric substrate;

forming, in a matrix configuration, a plurality of pairs of ohmic contacts on said epitaxial layer;

forming, in a matrix configuration, a plurality of Schottky barrier electrodes on said epitaxial layer, said plurality of Schottky barrier electrodes being associated with and disposed between respective pairs of said pairs of ohmic contacts;

slicing said substrate and said epitaxial layer such that said matrix of Schottky barrier electrodes and pairs of ohmic contacts are separated into a plurality of linear arrays;

forming radiating slots in one surface of said substrate and said epitaxial layer of each of said linear arrays; and affixing an absorber means to one end of each of said linear arrays.

12. The method according to claim 11 further comprising:

combining a first and second linear array by bonding together the surfaces opposite the epitaxial layers of the semi-insulating substrates of said arrays such that the epitaxial layer of said first and second arrays form opposing outer surfaces.

* * * * *